US006772855B2

(12) United States Patent
Tomiyama et al.

(10) Patent No.: US 6,772,855 B2
(45) Date of Patent: Aug. 10, 2004

(54) DAMPER FOR SPEAKER AND METHOD OF PRODUCING THE SAME

(75) Inventors: Hiroyuki Tomiyama, Yamagata (JP); Masatoshi Sato, Yamagata (JP); Satoshi Hachiya, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 0 days.

(21) Appl. No.: 09/973,808

(22) Filed: Oct. 11, 2001

(65) Prior Publication Data

US 2002/0043424 A1 Apr. 18, 2002

(30) Foreign Application Priority Data

Oct. 12, 2000 (JP) ..... 2000-312471
Jul. 4, 2001 (JP) ..... 2001-203877

(51) Int. Cl.[7] ..... G10K 13/00; H04R 7/00
(52) U.S. Cl. ..... 181/172; 181/208
(58) Field of Search ..... 181/157, 167, 181/169, 170, 171, 172, 173, 207, 208, 290, 286, 294, 295; 428/215, 414, 423.5, 7, 473.5, 494, 518, 77

(56) References Cited

U.S. PATENT DOCUMENTS 4,734,323 A * 3/1988 Sato et al. ..... 428/317.3
5,512,715 A * 4/1996 Takewa et al. ..... 181/295
5,945,643 A * 8/1999 Casser ..... 181/290
6,039,145 A * 3/2000 Ogura et al. ..... 181/167
6,144,753 A * 11/2000 Ohyaba et al. ..... 381/405

* cited by examiner

*Primary Examiner*—Robert Nappi
*Assistant Examiner*—Renata McCloud
(74) *Attorney, Agent, or Firm*—Sughrue Mion, PLLC

(57) ABSTRACT

A damper for a speaker includes an auxiliary damper 12 impregnated with a thermosetting resin, a laminate film 121 laminated on the auxiliary damper 12, and a primary damper formed on the auxiliary damper 12 or the laminate film 121. Alternatively, the damper may include the auxiliary damper 12 impregnated with the thermosetting resin (phenol) and coated with a coating agent, and the primary damper formed on the auxiliary damper and the coating agent 122. Thus, the dual damper which has enhanced reliability in resisting a high power and can be produced at a low cost without variation in the production can be obtained.

9 Claims, 4 Drawing Sheets

DAMPER FOR SPEAKER AND METHOD OF PRODUCING THE SAME

BACKGROUND OF THE INVENTION

1. Field of the Invention

The present invention relates to a damper for a speaker whose neck portion is formed of a plurality of dampers, and a method of producing the same.

2. Description of the Related Art

FIG. 7 shows a general structure of a speaker provided with a damper. The damper for supporting a vibration system of the speaker as shown in FIG. 7 generally has a number of corrugations 75 concentrically formed on the damper 74.

In FIG. 7, numeral 71 represents a speaker body, and 72 represents a magnetic circuit. The magnetic circuit 72 consists of a yoke 76, a center pole 77, a magnet 78, and a top plate 79. Numerals 80, 81, and 82 represent a frame, a diaphragm, and a coil bobbin respectively.

Usually, the damper 74 is molded by impregnating a material for the damper 74 with a thermosetting resin, and then, hardening the thermosetting resin by a heating press into a shape of the damper.

However, in the damper produced through the above process, there often occurs a problem of so-called neck break that a fabric is broken at a joint between the coil bobbin 82 and the damper 74, when a high power such as subwoofer is supplied.

Recently, as a countermeasure for such neck break, there has been employed a dual damper whose neck portion is molded of two sheets of dampers. By thus doubling the neck portion, a load on the neck portion will be dispersed, and as the results, the neck break will hardly occur.

This dual damper can be manufactured as shown in FIGS. 8A, 8B and 8C, by provisionally molding a fabric impregnated with a thermosetting resin as an auxiliary damper 92 (FIG. 8A), by applying or impregnating a thermosetting adhesive to the auxiliary damper 92 which reinforces the neck portion, after shaping a periphery of the auxiliary damper 92 (FIG. 8B), and by molding the auxiliary damper 92 simultaneously with a primary damper 91 to bond them to each other (FIG. 8C).

The thermosetting adhesive has been employed for the reason that the thermosetting resin is suitable for molding the damper into an appropriate shape, and particularly, the thermosetting adhesive is low in a unit price.

The above described dual damper has had a drawback that mass production has been difficult, because an additional step of applying the adhesive has been required in the production process.

There has been another drawback that because the adhesive is applied to the damper containing fibers, the adhesive may leak out through seams, and as the results, molds may be soiled when molding. Moreover, in order to improve point bonding between the fibers, directions of the seams must be aligned, when boding the fibers to one another, thus incurring bad workability.

Further, in case of a damper having a molding clearance such as an electrically conductive damper or the like, the thermosetting adhesive is difficult to be applied, and due to viscosity of the adhesive, an irregular adhesion may occur, resulting in an abnormal noise such as a rattle. In addition, the auxiliary damper must be attached to the primary damper concentrically so as not to disturb movements of the damper, and for this reason, the periphery of the auxiliary damper must be cut before bonding.

The present invention has been made in view of the above described circumstances, and its object is to provide a damper for a speaker and a method of producing the same in which reliability of the damper in resisting a high power will be enhanced, by molding the neck portion with a plurality of dampers consisting of a primary damper and an auxiliary damper. It is a further object of the invention to provide a damper for a speaker and a method of producing the same in which by employing a laminate film or a coating agent adjustable in thickness when bonding the auxiliary damper to the primary damper, they can be bonded irrespective of the seams, an irregular adhesion can be avoided, and the molds are less soiled. A still further object of the invention is to provide a damper for a speaker and a method of producing the same in which by simultaneously molding the auxiliary damper and the primary damper, production steps are reduced in number, variation in the production can be eliminated, manufacturing cost will be reduced, and at the same time, an anti-vibration effect can be expected.

SUMMARY OF THE INVENTION

In order to solve the above described problems, there is provided, according to the present invention, a damper for a speaker comprising an auxiliary damper impregnated with a thermosetting resin, a laminate film laminated on the auxiliary damper, and a primary damper formed on the auxiliary damper or the laminate film.

Because the laminated film is allowed to melt and bonded to the auxiliary damper, the auxiliary damper can be bonded to the primary damper irrespective of the seams, and it will be possible to provide the damper for a speaker which is produced with enhanced workability, and at the same time, free from an irregular adhesion. It is a further effect of the invention that the molds will be less soiled, as compared with the conventional case in which the adhesive has been used.

According to a second aspect of the present invention, there is provided a damper for a speaker comprising an auxiliary damper impregnated with a thermosetting resin and coated with a coating agent, and a primary damper formed on the auxiliary damper or the coating agent.

Because the coating agent is allowed to melt and bonded to the auxiliary damper, the auxiliary damper can be bonded to the primary damper irrespective of the seams, and it will be possible to provide the damper for a speaker which is produced with enhanced workability, and at the same time, free from an irregular adhesion. It is a further effect of the invention that the molds will be less soiled, as compared with the conventional case in which the adhesive has been used.

According to another aspect of the invention, the auxiliary damper is composed of a plurality of sheets.

As the results, reliability of the damper in resisting a high power at the neck portion can be enhanced, and the damper can be produced at a low cost without variation in the production.

According to still another aspect of the invention, there is provided a method of producing a damper for a speaker comprising the steps of laminating a film on an auxiliary damper which has been impregnated with a thermosetting resin, and bonding a primary damper to the auxiliary damper or the laminated film.

Because the laminated film is allowed to melt and bonded to the auxiliary damper, the auxiliary damper can be bonded to the primary damper irrespective of the seams, and it will be possible to provide the damper for a speaker which is produced with enhanced workability, and at the same time, free from an irregular adhesion. It is a further effect of the invention that the molds will be less soiled, as compared with the conventional case in which the adhesive has been used. It is a still further effect of the invention that because the auxiliary damper and the primary damper can be simultaneously molded, the production steps will be reduced in number as compared with the conventional case in which the adhesive has been used.

According to a further aspect of the invention, the method further comprises a step of cutting a periphery of the auxiliary damper into a predetermined shape, after the step of laminating the film.

This will eliminate a necessity of attaching the auxiliary damper concentrically to the primary damper so as not to disturb movements of the damper. Therefore, there is no need of cutting the periphery of the auxiliary number in advance, and workability will be enhanced.

According to a still further aspect of the invention, the primary damper is bonded to the auxiliary damper or the laminated film by varying a thickness of the laminated film. Accordingly, even though the molds having clearances have been employed, the areas of the damper having the clearances can be easily bonded, by varying the thickness of the laminate film.

According to a still further aspect of the invention, there is provided a method of producing a damper for a speaker comprising the steps of applying a coating agent on an auxiliary damper which has been impregnated with a thermosetting resin, and bonding a primary damper to the auxiliary damper coated with the coating agent.

Because the coating agent is allowed to melt and bonded to the auxiliary damper, the auxiliary damper can be bonded to the primary damper irrespective of the seams, and it will be possible to provide the damper for a speaker which is produced with enhanced workability, and at the same time, free from an irregular adhesion. It is a further effect of the invention that the molds will be less soiled, as compared with the conventional case in which the adhesive has been used. It is a still further effect of the invention that because the auxiliary damper and the primary damper can be simultaneously molded, the production steps will be reduced in number as compared with the conventional case in which the adhesive has been used.

According to a still further aspect of the invention, the primary damper is bonded to the auxiliary damper by varying a thickness of the coating agent. By thus varying the thickness of the coating agent, even the damper produced with the molds having clearances can be easily bonded.

DESCRIPTION OF THE PREFERRED EMBODIMENTS

Figure 1A:
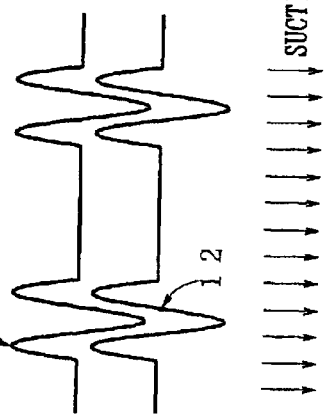
FIGS. 1A, 1B and 1C are views showing production steps of a damper for a speaker in a first embodiment according to the present invention.
Figure 1B:
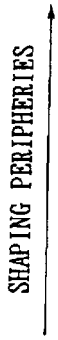
Figure 1C:
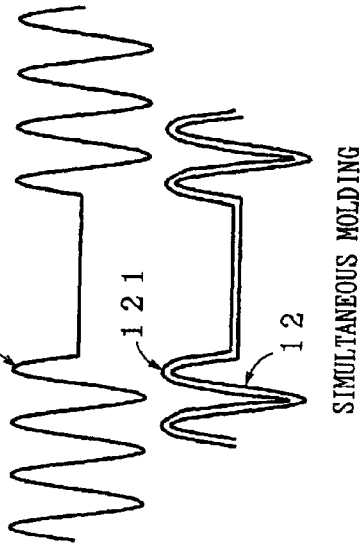

FIGS. 1A, 1B and 1C are views showing production steps of a damper for a speaker in a first embodiment according to the present invention. There are shown in these drawings, the production steps of a dual damper employing a laminate film.

In the step of FIG. 1A, a fabric impregnated with a thermosetting resin is molded as an auxiliary damper 12. Then, a laminate film 121 is laminated thereon, and brought into tight contact with the auxiliary damper 12 by suction.

Then, in the step of FIG. 1B, peripheries of both the laminate film 121 and the auxiliary damper 12 are shaped. Finally, in the step of FIG. 1C, molding of a primary damper 11 and bonding of the auxiliary damper 12 are simultaneously conducted at an adhesion temperature of 180 to 300° C. This adhesion temperature varies depending on a hardening temperature of the thermosetting resin impregnated in the material of the damper.

Dilution ratio of the thermosetting resin impregnated in the fabric material is 5 to 83%, and a resin film having a thickness of 10 to 150 $\mu$m is used as the resin film 121 to be laminated.

Figure 2A:
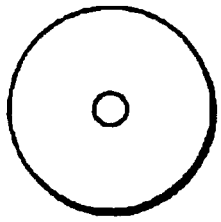
FIGS. 2A, 2B and 2C are views showing production steps of a damper for a speaker in a second embodiment according to the present invention.
Figure 2B:
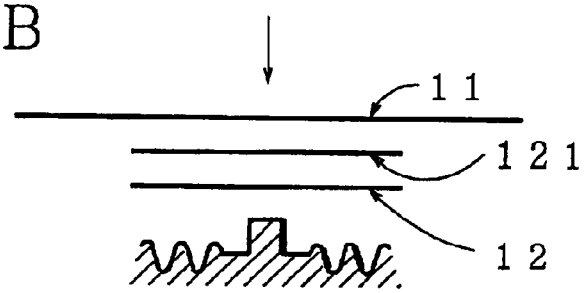
Figure 2C:
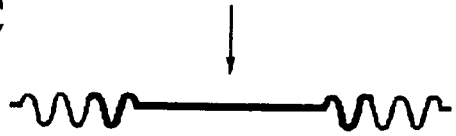

FIGS. 2A, 2B and 2C are views showing production steps of a damper for a speaker in a second embodiment according to the present invention. In the step of FIG. 2A, the peripheries and center holes of both the auxiliary damper 12 and the laminate film 121 are shaped. The reason for forming the center holes is to guide a center of the damper.

Then, in the step of FIG. 2B, the primary damper 11 formed of electrically conductive material is overlaid on the auxiliary damper 12 and the laminate film 121, and subjected to simultaneous bonding and molding by a heating press. Further, in the step of FIG. 2C, a periphery and a center hole of the double sheeted damper are shaped, thus completing the damper having a double sheeted neck portion.

Figure 3A:
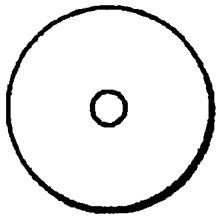
FIGS. 3A and 3B are views showing production steps of a damper for a speaker in a third embodiment according to the present invention.
Figure 3B:
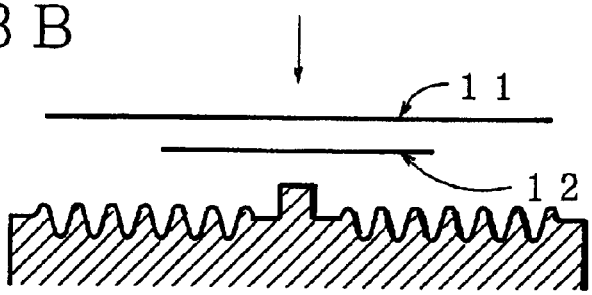

It is to be noted that the periphery and the center hole of the auxiliary damper coated with a resin as described below may be formed in advance, and then, the primary damper 11 which has been already impregnated with the thermosetting resin and the auxiliary damper 12 may be simultaneously molded by the heating press. This production process is illustrated in FIGS. 3A and 3B.

Figure 4A:
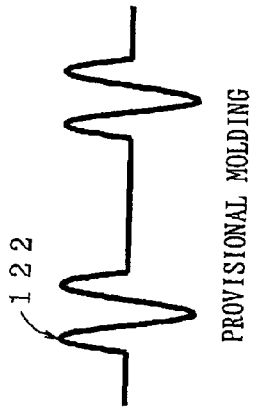
FIGS. 4A, 4B and 4C are views showing production steps of a damper for a speaker in a fourth embodiment according to the present invention.
Figure 4B:
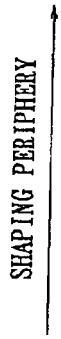
Figure 4C:
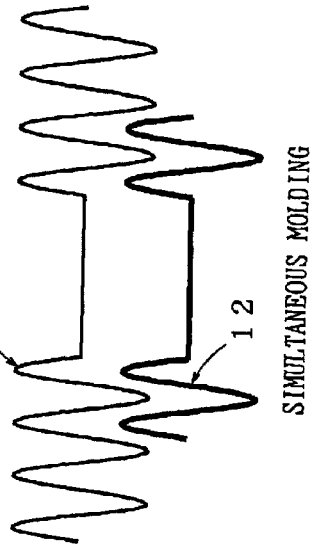

FIGS. 4A, 4B and 4C are views showing production steps of a damper for a speaker in a fourth embodiment according to the present invention. In the drawings, the production steps of a dual damper employing a coating agent are illustrated.

More specifically, in the step of FIG. 4A, a fabric 122 impregnated with phenol as the thermosetting resin and coated with the coating agent is provisionally molded as the auxiliary damper 12. Molding temperature is set to be 200 to 240° C. in this embodiment, although the molding temperature varies depending on types of the coating agent. The molding temperature also varies depending on softening or melting temperature of the resin during bonding.

Then, in the step of FIG. 4B, the periphery of the auxiliary damper is shaped, and in the step of FIG. 4C, molding of the primary damper 11 and bonding of the auxiliary damper 12 are conducted simultaneously. Similarly to the embodiment as shown in FIG. 1, the adhesion temperature is 180 to 300° C.

Material for the coating agent 122 to be applied on the fabric may be rubber, acrylic, or urethane, which can be appropriately selected according to magnitudes of vibrations of the speaker. The coating agent 122 having a thickness of 10 to 150 $\mu$m is employed in this embodiment.

FIGS. 5A, 5B, 5C and FIGS. 6A, 6B are views showing production steps of dampers for a speaker in still further embodiments according to the present invention. In these embodiments, in order to strengthen the neck portion and to adjust hardness of the damper, the auxiliary damper is composed of a plurality of sheets.

Figure 5A:
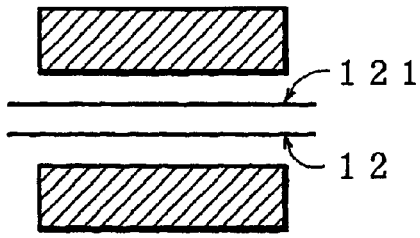
FIGS. 5A, 5B and 5C are views showing production steps of a damper for a speaker in a fifth embodiment according to the present invention.
Figure 5B:
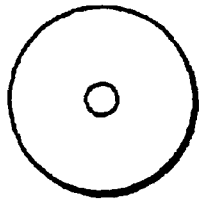
Figure 5C:
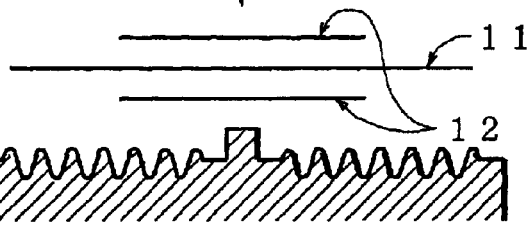

FIGS. 5A, 5B, 5C show an example in which a laminate film is employed. Specifically, in the step of FIG. 5A, the laminate film 121 is provisionally bonded to the auxiliary damper 12 which has been impregnated with a thermosetting resin at an adhesion temperature of 100 to 200° C. In the step of FIG. 5B, the periphery and the center hole are shaped. Then, in the step of FIG. 5C, the primary damper 11 and the auxiliary damper 12 are simultaneously molded by the heating press. The adhesion temperature in this case is 180 to 300° C. similarly to the embodiment as shown in FIG. 1.

Figure 6A:
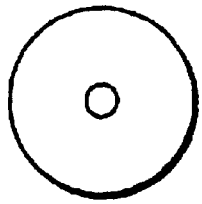
FIGS. 6A and 6B are views showing production steps of a damper for a speaker in a sixth embodiment according to the present invention.
Figure 6B:
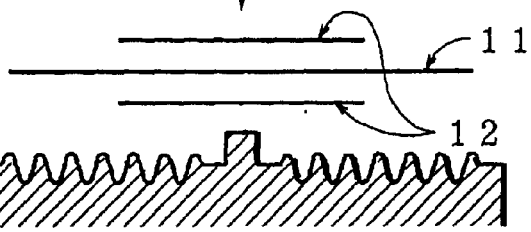
Figure 7:
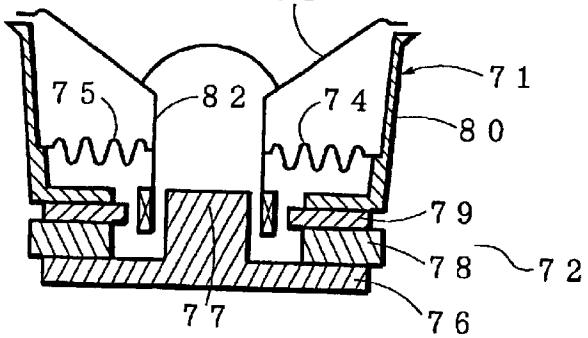
FIG. 7 is a view for explaining a general structure of the speaker and the damper.
Figure 8A:
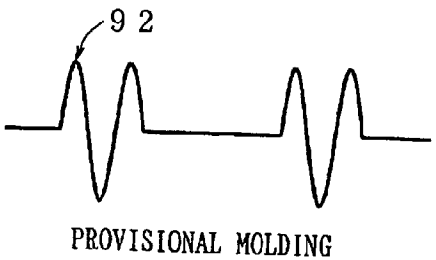
FIGS. 8A, 8B and 8C are views for explaining production steps of a conventional dual damper.
Figure 8B:
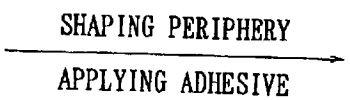
Figure 8C:
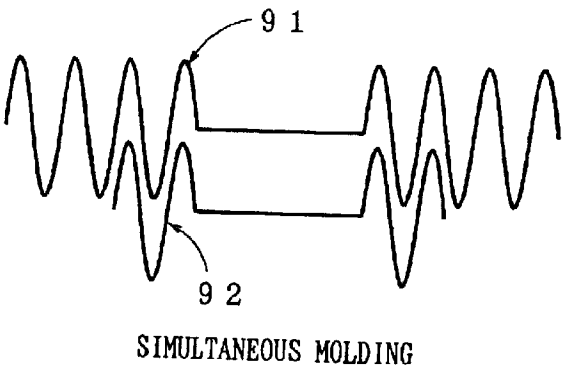

FIGS. 6A, 6B show an example in which a coating agent is employed. Specifically, in the step of FIG. 6A, the periphery and the center hole of the auxiliary damper are shaped. Then, in the step of FIG. 6B, the primary damper 11 and the auxiliary damper 12 are simultaneously molded by the heating press. The adhesion temperature in this case is also 180 to 300° C. similarly to the embodiment as shown in FIG. 1.

As described herein above, according to the present invention, the laminate film 121 or the coating agent 122 which can be adjusted in thickness is employed, when the auxiliary damper 12 is bonded to the primary damper 11. Accordingly, it is possible to provide the damper for a speaker and the method of producing the same in which the bonding can be conducted irrespective of the seams in the fabric material, and in which an irregular adhesion can be avoided, the molds will be less soiled, the production steps are decreased in number because of the simultaneous molding, and further, anti-vibration effects can be expected.

Even though the molds having clearances have been employed, the areas of the damper having the clearances can be easily bonded, by varying the thickness of the laminate film 121. In case where the coating agent 122 is employed, the damper produced with the molds having the clearances also can be easily bonded, by varying the thickness of the coating agent 122 in the same manner as the laminate film 121.

Although the present invention has been fully described by way of examples with reference to the accompanying drawings, it is to be noted that various changes and modifications can be made within the scope of the present invention. Incidentally, the contents of Japanese Patent Applications Nos. 2000-312471 and 2001-203877 are hereby incorporated by reference.

What is claimed is:

1. A damper for a speaker comprising:

an auxiliary damper impregnated with a thermosetting resin, a laminate film laminated on said auxiliary damper, and a primary damper formed on said auxiliary damper or said laminate film, whereby said laminate film is between said auxiliary damper and said primary damper.

2. A damper for a speaker comprising:

an auxiliary damper impregnated with a thermosetting resin and coated with a coating agent, and a primary damper formed on said auxiliary damper or said coating agent, whereby said coating agent is between said auxiliary damper and said primary damper.

3. A damper for a speaker comprising:

an auxiliary damper impregnated with a thermosetting resin, a laminate film laminated on said auxiliary damper, and a primary damper formed on said auxiliary damper or said laminate film, wherein said auxiliary damper is composed of a plurality of sheets.

4. A damper for a speaker comprising:

an auxiliary damper impregnated with a thermosetting resin and coated with a coating agent, and a primary damper formed on said auxiliary damper or said coating agent, wherein said auxiliary damper is composed of a plurality of sheets.

5. A method of producing a damper for a speaker comprising the steps of:

laminating a film on an auxiliary damper which has been impregnated with a thermosetting resin, and bonding a primary damper to said auxiliary damper or said laminated film, whereby said laminate film is between said auxiliary damper and said primary damper.

6. The method of producing the damper for a speaker as claimed in claim 5, further comprising a step of cutting a periphery of said auxiliary damper into a predetermined shape, after said step of laminating said film.

7. The method of producing the damper for a speaker as claimed in claim 5, wherein said primary damper is bonded to said auxiliary damper or said laminated film by varying a thickness of said laminated film.

8. A method of producing a damper for a speaker comprising the steps of:

applying a coating agent on an auxiliary damper which has been impregnated with a thermosetting resin, and bonding a primary damper to said auxiliary damper coated with said coating agents whereby said coating agent is between said auxiliary damper and said primary damper.

9. The method of producing the damper for a speaker as claimed in claim 8, wherein said primary damper is bonded to said auxiliary damper by varying a thickness of said coating agent.

* * * * *